US008502093B2

(12) United States Patent
Kishimoto et al.

(10) Patent No.: US 8,502,093 B2
(45) Date of Patent: Aug. 6, 2013

(54) MULTIDIRECTIONAL OPERATING SWITCH

(75) Inventors: Takayoshi Kishimoto, Osaka (JP); Mitsuo Kodama, Fukui (JP); Masaki Kontani, Fukui (JP)

(73) Assignee: Panasonic Corporation, Osaka (JP)

( * ) Notice: Subject to any disclaimer, the term of this patent is extended or adjusted under 35 U.S.C. 154(b) by 335 days.

(21) Appl. No.: 12/885,671

(22) Filed: Sep. 20, 2010

(65) Prior Publication Data

US 2011/0073457 A1 Mar. 31, 2011

(30) Foreign Application Priority Data

Sep. 30, 2009 (JP) ..... 2009-226934
Jul. 8, 2010 (JP) ..... 2010-155641

(51) Int. Cl.
*H01H 9/26* (2006.01)
*H01H 13/72* (2006.01)
*H01H 13/76* (2006.01)

(52) U.S. Cl.
USPC ..... 200/5 A; 200/4; 200/6 A

(58) Field of Classification Search
USPC ..... 200/5 A, 4, 6 A, 6 R, 5 R, 329
See application file for complete search history.

(56) References Cited

U.S. PATENT DOCUMENTS 6,720,504 B2 * 4/2004 Nishimoto et al. ..... 200/4
7,310,084 B2 12/2007 Shitanaka et al.

FOREIGN PATENT DOCUMENTS

JP 2006-12695 1/2006

* cited by examiner

*Primary Examiner* — Renee Luebke
*Assistant Examiner* — Lheiren Mae Caroc
(74) *Attorney, Agent, or Firm* — Wenderoth, Lind & Ponack, L.L.P.

(57) ABSTRACT

In a multidirectional operating switch, an operating body has a support having a spherically convex surface on the lower end of a central cylinder, and a holding base has a retainer having a spherically concave surface disposed opposite to the support. Through the movement of the support sliding over the retainer, the holding base retains the operating body rockably in multiple directions. The rotational center of the rocking movement of the operating body coincides with the position at which the push element is in contact with the push section disposed at the lower end of the operation button.

21 Claims, 14 Drawing Sheets

MULTIDIRECTIONAL OPERATING SWITCH

BACKGROUND OF THE INVENTION

1. Field of the Invention

The present invention relates to a multidirectional operating switch mainly used for operating electronic equipment mounted on a car.

2. Background Art

In recent years, a car having a switch disposed on a steering wheel has become familiar to people. While holding the steering wheel, the driver operates the switch with the finger to control electronic equipment such as a car audio device or an automotive air conditioner. Under the circumstances, there has been a growing demand for a switch with user-friendly and reliable operation. Hereinafter, a conventional multidirectional operating switch will be described with reference to FIGS. 12 through 14B.

FIG. 12 is a sectional view of a conventional multidirectional operating switch. FIG. 13 is an exploded perspective view of the switch. FIGS. 14A and 14B are sectional views of the multidirectional operating switch of FIG. 12 in operation. Multidirectional operating switch 20 has case 1, operating body 2, operation button 3, push piece 4, holding base 5, wiring board 6, and push elements 10A and 10B.

Case 1 is made of insulating resin and is formed into a box-like shape. Case 1 has opening 1A on the top. Operating body 2 is made of insulating resin and is formed into a cylindrical shape. Operating body 2 has operation face 2F on the top. Operation face 2F is exposed out of opening 1A. Operating body 2 is accommodated in case 1. Operating body 2 has a plurality of operating sections 2A where translucent display sections 2B are exposed at predetermined positions in the periphery of operation face 2F.

Operation button 3 has a cylindrical shape. On the lower end of push piece 4, push section 4A protrudes downwardly. Push piece 4 is disposed inside operation button 3. Operation button 3 is accommodated in recess 2G disposed in the center of operating body 2 so as to be movable in the vertical direction but so as not to be upwardly pulled off.

Holding base 5 is made of insulating resin and is formed into a bottom-opened box shape. In the periphery of the center of the upper surface of holding base 5, locking sections 5A, each of which is formed into an upwardly protruding hook, are oppositely disposed. Locking sections 5A are held by holding base 5 so as to be engaged with catching holes 2C formed under recess 2G of operating body 2. This allows operating body 2 to be movable in "crisscross" (i.e. front, back, right, and left) directions.

Wiring board 6 has a plurality of wiring patterns (not shown) on both surfaces. On the upper surface of wiring board 6, central switch 7 formed of, for example, a push switch having push button 7A thereon, is mounted. In the periphery of central switch 7, a plurality of peripheral switches 8 formed of a push switch, light-emitting diodes (LEDs) 9, and other electronic components are mounted on the upper surface of wiring board 6. Peripheral switches 8 are arranged at four equally-spaced positions (of front, back, right, and left) so as to be concentric with central switch 7.

Each of push elements 10A and 10B has a cylindrical upper part and a disc-like lower part. Push element 10A is inserted through guiding hole 5B formed in the center of holding base 5. The lower end of push element 10A makes contact with the top surface of push button 7A of central switch 7. The upper end of push element 10A makes contact with push section 4A disposed at the lower end of push piece 4.

Push elements 10B are inserted through guiding holes 5C, respectively. The lower end of each push element 10B makes contact with the top surface of push button 8A of peripheral switches 8, and the upper end of each push element 10B makes contact with downwardly protruding push section 2D disposed in the vicinity of the periphery of operating body 2.

Case 1 accommodating operating body 2 and holding base 5 is fixed to wiring board 6 with screws 11. Multidirectional operating switch 20 is thus completed.

Multidirectional operating switch 20 is attached between the steering wheel and an airbag built-in pad, such that operation face 2F of operating body 2 and the top surface of push button 3 face the driver. Central switch 7 and peripheral switches 8 are electrically connected to the electronic circuits of the car (not shown) via connectors and lead wires (not shown).

FIG. 14 shows the state where the driver pushes right-side operating section 2A with the thumb while holding the steering wheel. At that moment, operating body 2 has a right-downward tilt around engaging section 2E as a fulcrum at which locking section 5A engages in catching hole 2C disposed in the lower left. The tilt allows push section 2D disposed at the lower end of operating section 2A to move downward and press push button 8A via push element 10B, so that corresponding peripheral switch 8 is operated. In response to signals from peripheral switch 8, a predetermined operation is carried out via a corresponding electronic circuit such as, for example, the audio device being set into a selection mode for selecting compact disc-music numbers.

Next, the driver pushes operation button 3 in the center, as shown in FIG. 14B. The pushing force on operation button 3 lowers push piece 4, allowing push section 4A to press push button 7A via push element 10A, so that central switch 7 is operated. In response to signals from central switch 7, a predetermined operation is carried out. For example, the music number that has been selected in the operation by operating section 2A is played.

When the driver pushes operating section 2A on the upper side or the lower side of operating body 2, operating body 2 tilts in the pushed direction, and peripheral switch 8 disposed under the pushed position is operated. Through the operation, for example, the volume level of the audio device is controlled.

In the night or in a dark place, such as in a tunnel, when the driver operates a lighting switch (not shown) other than multidirectional operation switch 20, an electronic circuit of the car allows LEDs 9 to emit light. The light of each LED 9 goes through a cylindrical light guiding section of holding base 5 and illuminates display section 2B of operating section 2A disposed above. Such illuminated operating section 2A provides the driver with easy recognition for operation.

As is shown in FIG. 14A, in response to the driver's pushing force on right-side operating section 2A, operating body 2 has a right-downward tilt around engaging section 2E as a fulcrum on off-centered in the left under operating body 2. At that time, push section 4A at the lower end of operation button 3 slightly lowers with the tilt of operating body 2, by which push button 7A can be lowered. If the components have poor accuracy in dimension or have expansion or contraction in an operating environment, unintended pushing force can be exerted on central switch 7.

As described above, the tilt of operating body 2 in response to the pushing operation on peripheral operating section 2A can invite unwanted electrical connection of central switch 7 disposed under operation button 3, resulting in unintended operation of electronic equipment, such as an audio device.

SUMMARY OF THE INVENTION

The multidirectional operating switch of the present invention has a box-shaped case provided with an opening, an operating body, a holding base, a plurality of peripheral push elements, a plurality of peripheral switches, an operation button, a central push element, and a central switch. The operating body, which is accommodated in the case, has an operation face, a central cylinder, and a support. The operation face is exposed out of the opening of the case. The central cylinder extends from a rear side of the operation face. The support has a spherically convex surface and is disposed at the lower end of the central cylinder. The holding base has a retainer at a position opposite to the support of the operating body. The retainer has a spherically concave surface and makes contact with the support. The holding base is accommodated in the case and holds the operating body to be rockable in predetermined multiple directions. The peripheral push elements are disposed in the rockable directions of the operating body, respectively and are guided by the retainer. When the operating body tilts, the peripheral switch located in the tilt direction has electrical connection via corresponding peripheral push element. Exposed at the opening of the case, the operation button is disposed in the central cylinder of the operating body so as to be movable linearly. The central push element is disposed in the moving direction of the operation button and is guided by the holding base. When the operation button is pushed, the central push element allows the central switch to have electrical connection. When the operating body tilts, the rotational center (the pivot) of the operating body coincides with the contact point of the operation button and the central push element.

DETAILED DESCRIPTION OF THE INVENTION

An exemplary embodiment of the present invention is described hereinafter with reference to the accompanying drawings. It is to be understood that the present invention is not limited to the embodiment described below.

Figure 1:
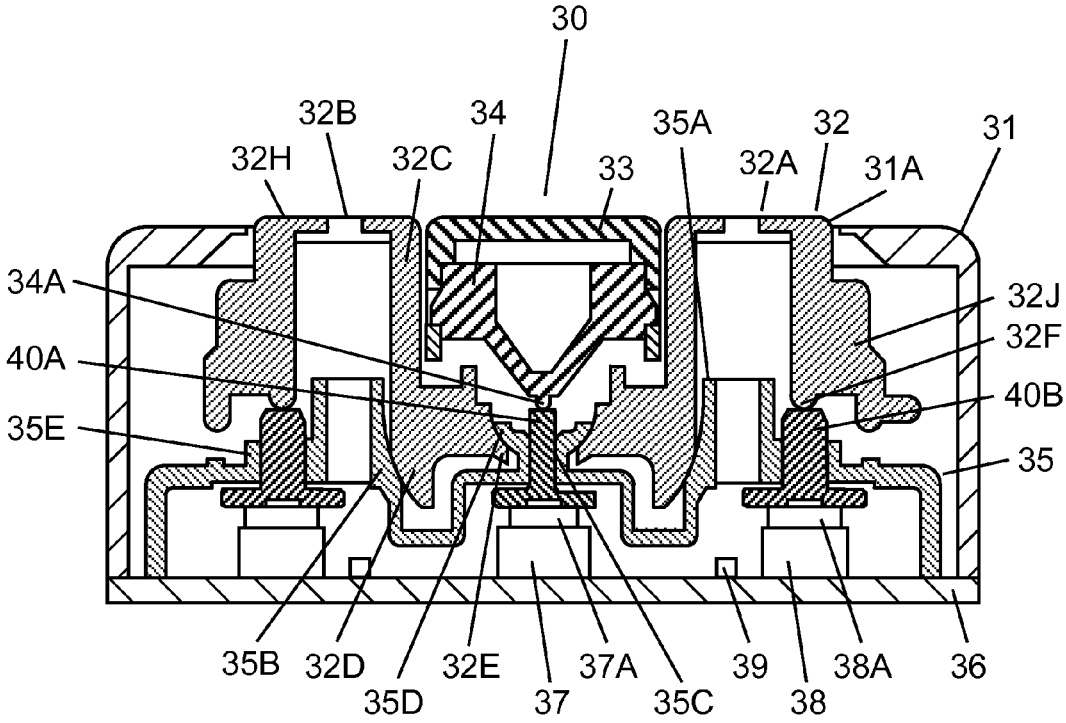
FIG. 1 is a sectional view showing a multidirectional operating switch in accordance with an exemplary embodiment of the present invention.
Figure 2:
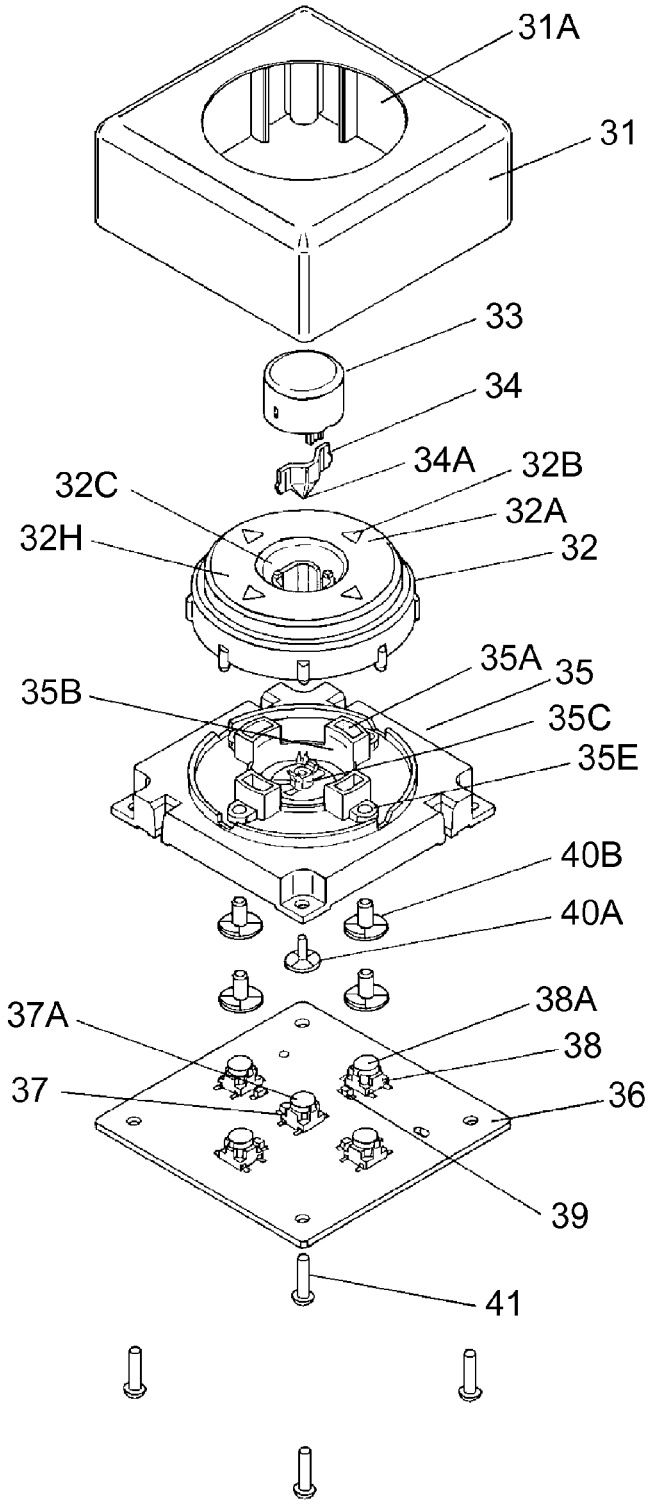
FIG. 2 is an exploded perspective view showing the multidirectional operating switch shown in FIG. 1.
Figure 3:
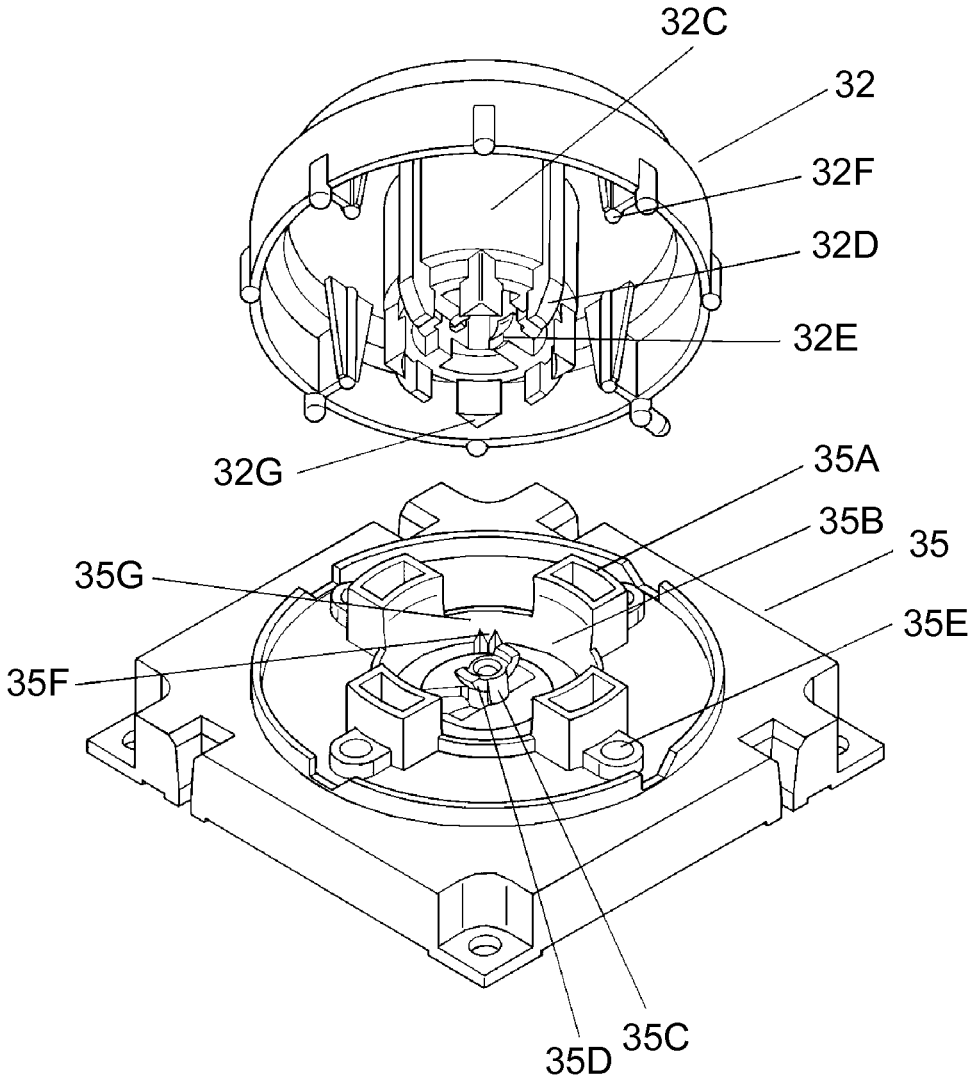
FIG. 3 is a perspective view showing the essential part of the multidirectional operating switch shown in FIG. 1.
Figure 4:
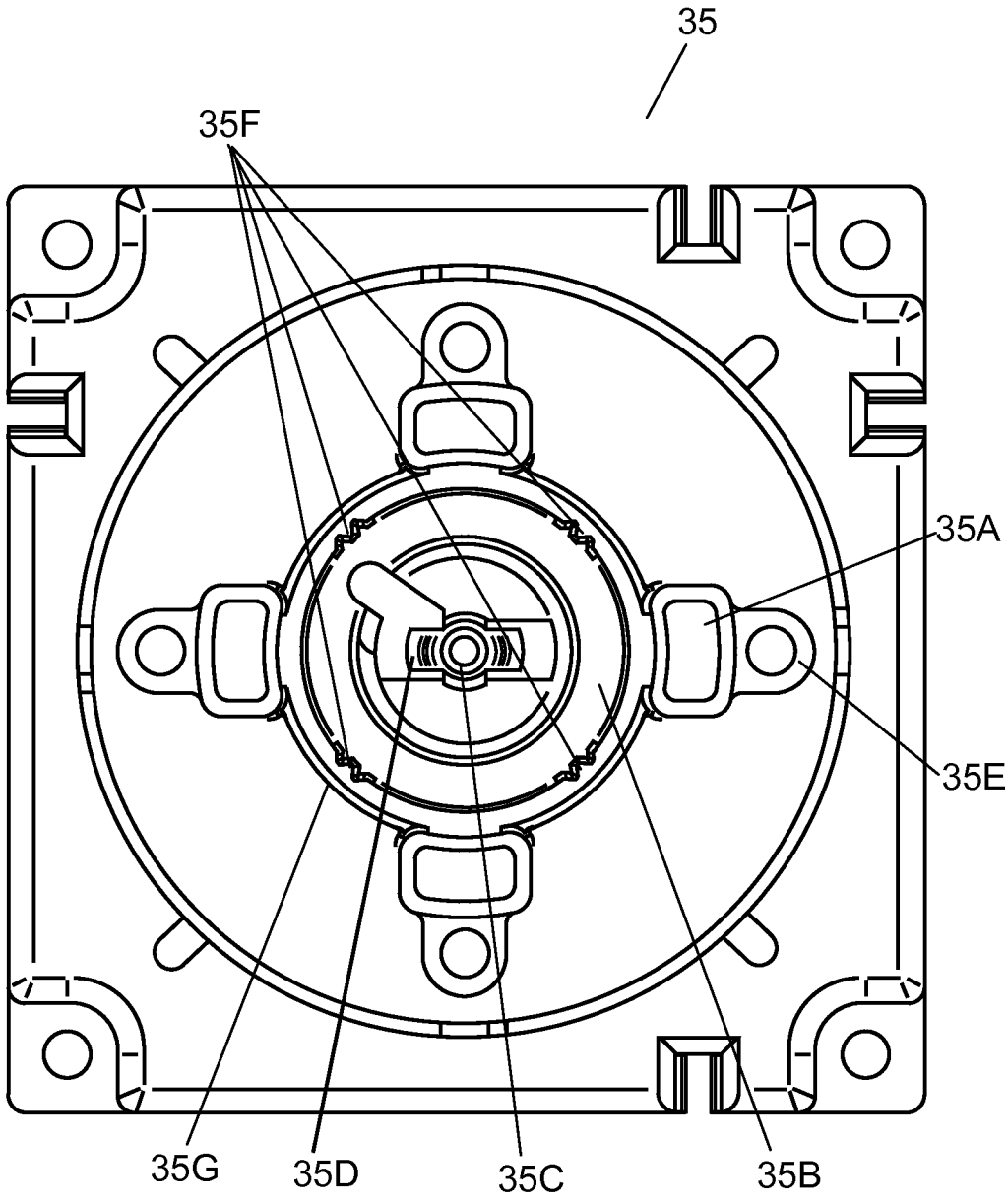
FIG. 4 is a top view showing a holding base of the multidirectional operating switch shown in FIG. 1.

FIG. 1 and FIG. 2 are a sectional view and an exploded perspective view, respectively, showing the structure of a multidirectional operating switch in accordance with the embodiment of the present invention. FIG. 3 is a perspective view showing the essential part of the multidirectional operating switch shown in FIG. 1. FIG. 4 is a top view showing a holding base of the multidirectional operating switch shown in FIG. 1. Multidirectional operating switch 30 has box-shaped case 31 provided with opening 31A, operating body 32, holding base 35, a plurality of peripheral push elements (hereinafter, referred to as push elements) 40B, a plurality of peripheral switches 38, operation button 33, push piece 34, central push element (hereinafter, push element) 40A, and central switch 37.

Operating body 32, which is accommodated in case 31, has operation face 32H, central cylinder 32C, support 32D, and operating section 32A. Operation face 32H is exposed upwardly out of opening 31A of case 31. Central cylinder 32C extends downwardly from the rear side of operation face 32H. Support 32D has a spherically convex surface and is disposed at the lower end of central cylinder 32C.

Holding base 35 has retainer 35B at a position opposite to support 32D of operating body 32. Retainer 35B has a spherically concave surface and makes contact with support 32D. Holding base 35 is accommodated in case 31 and retains operating body 32 by retainer 35B to be rockable (pivotable) in predetermined multiple directions.

Push elements 40B are disposed in the rockable directions of operating body 32 and are guided by holding base 35. When operating body 32 tilts, one of push elements 40B located in the tilt direction allows corresponding peripheral switch 38 to have electrical connection.

Exposed at opening 31A of case 31, operation button 33 is disposed in central cylinder 32C so as to be linearly movable. Push element 40A is disposed in the moving direction of operation button 33, i.e., disposed under operation button 33, and is guided by holding base 35. When operation button 33 is pushed, push element 40A allows central switch 37 to have electrical connection. When operating body 32 tilts, the rotational center (the pivot) of operating body 32 coincides with the contact position of operation button 33 and push element 40A.

Hereinafter, the components of the switch will be described in detail. Box-like case 31 is made of insulating resin, such as polycarbonate and acrylonitrile butadiene styrene resin (ABS). Cylindrical operating body 32 is also made of insulating resin, for example, polycarbonate. Operating body 32 is accommodated in case 31, with round operation face 32H of operating body 32 exposed out of opening 31A formed in the top of case 31. Operating sections 32A are disposed at four positions (corresponding to front, back, right, and left) around the periphery of operation face 32H. In each of operating sections 32A, display 32B which is formed into a translucent triangular shape, for example, is exposed. Operating section 32A has outer cylinder 32J disposed on the rear side of operation face 32H.

Cylindrical operation button 33 is made of insulating resin, such as polycarbonate. Operation button 33 is accommodated in central cylinder 32C recessed in the center of operation face 32H so as to be linearly movable in the vertical direction but so as not to be upwardly pulled off.

Push piece 34 is made of insulating resin, such as polycarbonate and ABS, and has an outline of an inverted pentagon. Dome-like push section 34A protrudes on the lower end of push piece 34. Push piece 34 is fixed in push button 33 in a manner that the left and the right ends of push piece 34 are engaged with the inner side of push button 33.

Box-shaped holding base 35 is made of insulating resin, such as polyoxymethylene and polybutylene terephthalate. As shown in FIG. 3, light guiding cylinders 35A are disposed on the upper surface of holding base 35. Each of light guiding cylinders 35A is located under each display 32B of operating body 32 so as to face corresponding display 32B. On the inner side of light guiding cylinders 35A, retainers 35B having a spherically concave surface are disposed downwardly. Retainers 35B are connected with wall 35G.

Downwardly protruded spherical supports 32D are formed in the crisscross directions on the bottom end of central cylinder 32C of operating body 32. Each of supports 32D makes contact with respective retainer 35B of holding base 35, so that operating body 32 is rockably retained by holding base 35.

In addition, holding base 35 has central guiding cylinder 35C located substantially at the center of retainers 35. On the upper part of central guiding cylinder 35C, a pair of pull-off protectors 35D protrude in the horizontal direction. Retainers 35B are arranged at equally spaced intervals so as to be substantially concentric with central guiding cylinder 35C.

Operating body 32 has a pair of locking parts 32E protruding downwardly and inwardly on the bottom of central cylinder 32C. In the state of FIG. 1 where operating body 32 is attached to holding base 35, pull-off protectors 35D stay on the curved concave inner side surface of locking parts 32E. In this way, holding base 35 protects operating body 32 from pulling off upwardly. Pull-off protector 35D has the outer surface that conforms to the curved shape of locking part 32E, allowing operating body 32 to pivot smoothly without jerky motion on holding base 35.

Figure 5A:
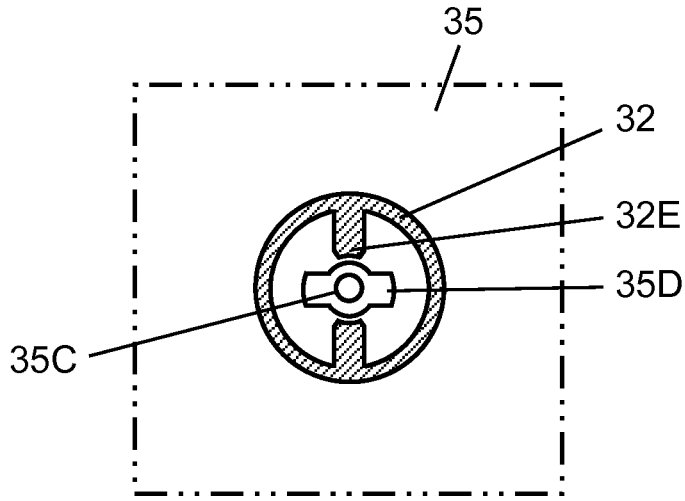
FIGS. 5A through 5C are sectional views showing the essential part of the multidirectional operating switch shown in FIG. 1.
Figure 5B:
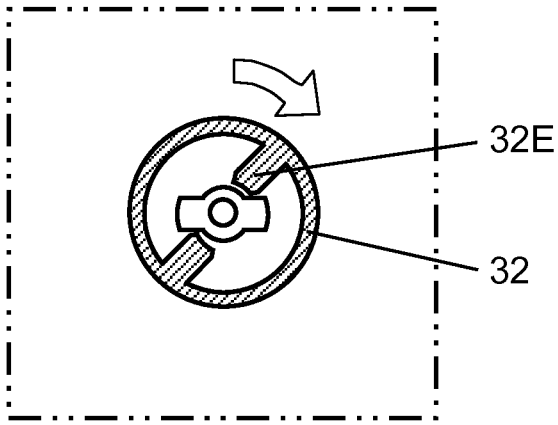
Figure 5C:
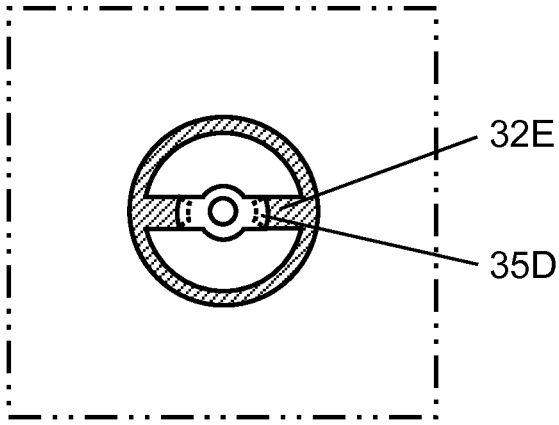

Hereinafter, the procedures for attaching operating body 32 to holding base 35 will be described with reference to FIGS. 5A through 5C. FIGS. 5A through 5C are sectional views showing the essential part of the multidirectional operating switch shown in FIG. 1.

First, holding base 35 is located with pull-off protectors 35D positioned along the horizontal direction, as shown in FIG. 5A. Operating body 32 is mounted on holding base 35, with locking parts 32E of operating body 32 being located in a front-back direction substantially perpendicular to the row direction of pull-off protectors 35D (in the vertical direction in FIG. 5A).

Next, rotating operating body 32 in a clockwise as shown in FIG. 5B allows locking parts 32E to move in the same direction and settle under pull-off protectors 35D in an overlapped arrangement shown in FIG. 5C. Through the procedures above, operating body 32 is attached to holding base 35 in a condition that holding base 35 protects operating body 32 from pulling off upwardly.

As described above, holding base 35 has a pair of pull-off protectors 35D on the upper surface, whereas operating body 32 has a pair of locking parts 32E on the lower surface. Operating body 32 is rotated with a predetermined angle from a predetermined position so that locking parts 32E engage with pull-off protectors 35D in an overlapped arrangement. With the simple structure and easy assembling procedures, operating body 32 is attached to holding base 35.

As shown in FIG. 3, central cylinder 32C of operating body 32 contains controllers 32G each having a triangular bottom. Disposed on the lower part of the periphery of central cylinder 32C, controllers 32G protrude downwardly.

Each of controllers 32G is disposed in midway between adjacent supports 32D in a manner such that a vertex of the triangular bottom is directed outwardly. Holding base 35 contains, as shown in FIGS. 3 and 4, receptors 35F each having a triangular top. Each of receptors 35F is disposed midway between adjacent retainers 35B in a manner such that a vertex of the triangular top is protruded toward an inner side of wall 35G. Receptors 35F and controllers 32G are arranged in pairs with their vertices oppositely disposed.

Figure 7A:
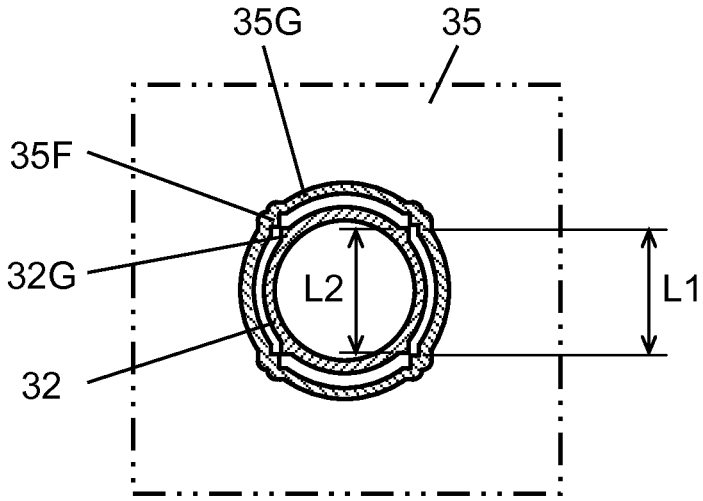
FIGS. 7A through 7C are sectional views showing the essential part of the multidirectional operating switch shown in FIG. 1.

Receptors 35F and controllers 32G will be described below with reference to FIG. 7A. FIG. 7A is a sectional view showing the essential part of the multidirectional operating switch shown in FIG. 1. Inner length L1 between adjacent receptors 35F is slightly greater than outer length L2 between adjacent controllers 32G that oppose receptors 35F above. This configuration allows operating body 32 to have a predetermined tilt range in response to the rocking movement of operating body 32 in the predetermined four directions of front, back, right, and left. Detailed explanation thereof will be described later.

Other components will be described first with reference to FIGS. 1 and 2. Push elements 40A and 40B are made of insulating resin, for example, polyoxymethylene. The upper part of each of push elements 40A and 40B is columnar and the lower part of them is disc-shaped. Push element 40A is inserted in central guiding cylinder 35C movably in the vertical direction. Each of push elements 40B is inserted in respective peripheral guiding cylinder 35E disposed at the outer periphery of light guiding cylinder 35A movably in the vertical direction.

Wiring board 36 is a phenol-resin-impregnated paper board or a glass-contained epoxy board and has a plurality of wiring patterns (not shown) on both surfaces. Wiring board 36 has electronic components on the upper surface, such as central switch 37, peripheral switches 38, and light-emitting diodes (LEDs) 39. Each of central switch 37 and peripheral switches 38 is formed of, for example, a push switch. On central switch 37, upwardly urged push button 37A is disposed. Similarly, on each peripheral switch 38, upwardly urged push button 38A is disposed. Peripheral switches 38 and LEDs 39 are disposed in the outer periphery of central switch 37; specifically, peripheral switches 38 are arranged at four equally-spaced positions so as to be substantially concentric with central switch 37.

The lower end of push element 40A is in contact with the upper surface of push button 37A. The upper end of push element 40A is in contact with push section 34A disposed at the lower end of push piece 34. The lower end of push element 40B is in contact with the upper surface of push button 38A. The upper end of push element 40B is in contact with the lower end of push section 32F protruding on the lower surface of outer cylinder 32J.

Retainer 35B of holding base 35 has a spherical surface with a predetermined radius. The center of the sphere is determined to coincide substantially with the position at which the upper end of push element 40A that pushes central switch 37 is in contact with push section 34A of push piece 34. This allows the rotational center of rocking movement of operating body 32 retained by holding base 35 to coincide substantially with the position at which the upper end of push element 40A is in contact with push section 34A.

Screws 41 fix wiring board 36 to the lower surface of case 31 accommodating operating body 32 and holding base 35. Multidirectional operating switch 30 is thus completed.

Figure 8:
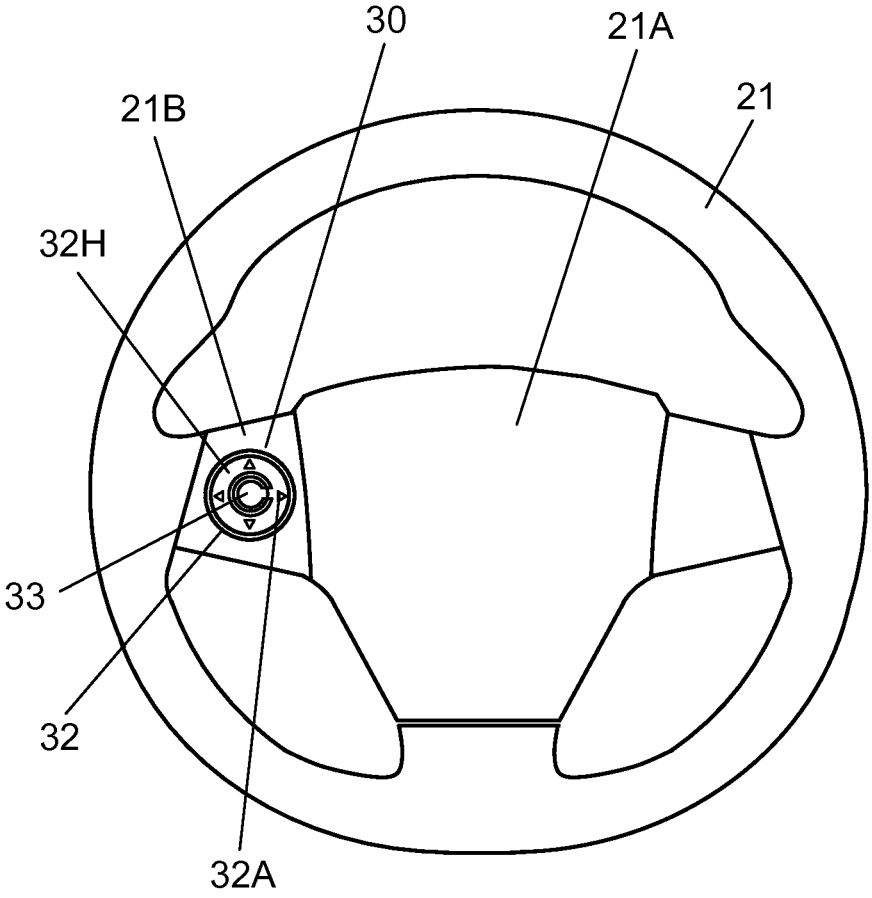
FIG. 8 is a plan view showing a steering wheel on which the multidirectional operating switch of the embodiment is mounted.

FIG. 8 is a plan view showing a steering wheel on which multidirectional operating switch 30 is mounted. Multidirectional operating switch 30 is attached between steering wheel 21 and airbag built-in pad 21A, with operation face 32H and the top surface of push button 33 facing the driver. For example, operating switch 30 is attached to left-side spoke 21B. Central switch 37 and peripheral switches 38 are electrically connected to the electronic circuits of the car (not shown) via connectors and lead wires (not shown).

Figure 6A:
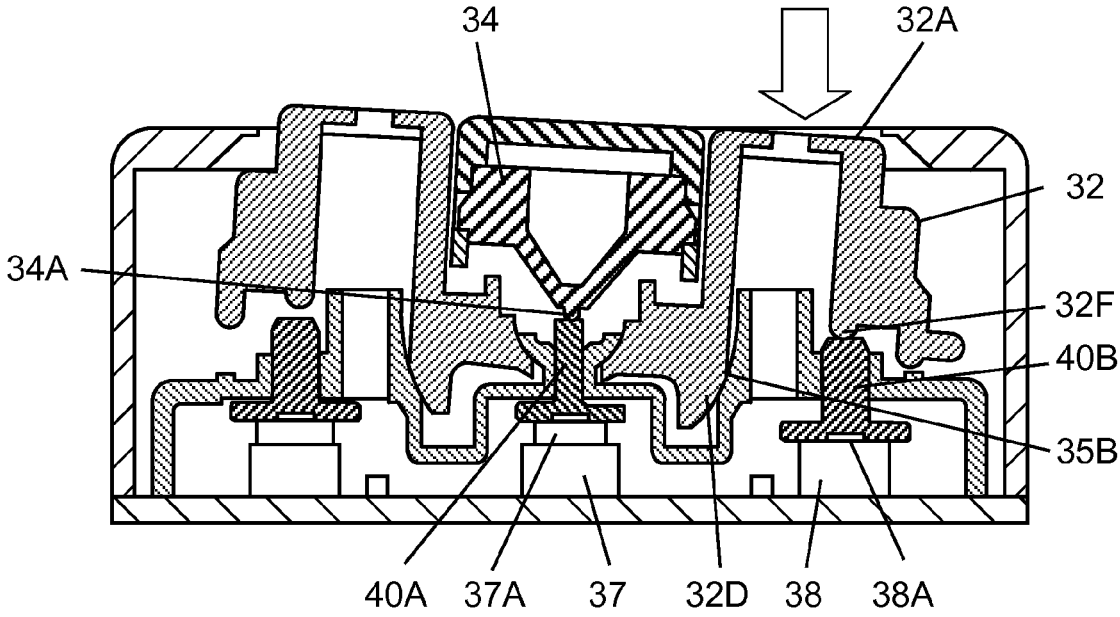
FIGS. 6A and 6B are sectional views of the multidirectional operating switch of FIG. 1 in operation.
Figure 6B:
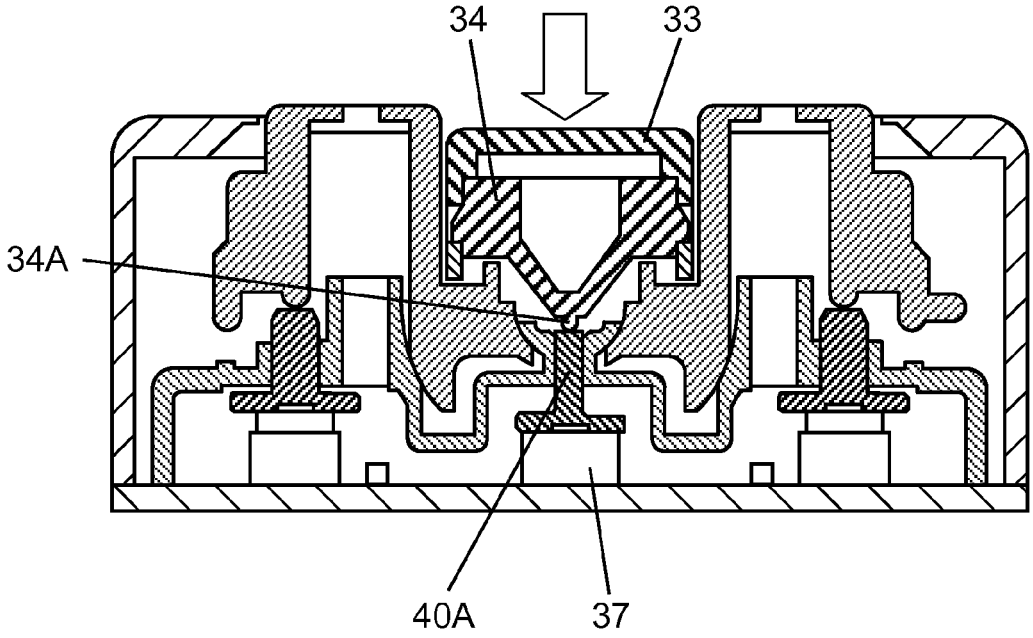

Next, how multidirectional operating switch 30 is operated by the driver will be described with reference to FIGS. 6A and 6B. FIGS. 6A and 6B are sectional views of multidirectional operating switch 30 in operation.

For example, the driver pushes operating section 32A on the right side of operating body 32 with the thumb while holding steering wheel 21. At that moment, as shown in FIG. 6A, support 32D undergoes rotational movement sliding on retainer 35B of holding base 35, allowing operating body 32 to attain a right-downward tilt. Through the tilt, push section 32F disposed on the lower part of operating body 32 moves downward and pushes push button 38A via push element 40B. As a result, electrical connection is established in peripheral switch 38. In response to signals from peripheral switch 38, a predetermined operation is carried out via a corresponding electronic circuit. For example, the audio device is placed into a selection mode for selecting compact disc-music numbers.

Next, the driver pushes operation button 33 in the center, as shown in FIG. 6B. The pushing force on operation button 33 lowers push piece 34, allowing push section 34A to press push button 7A via push element 40A. As a result, electrical connection is established in central switch 37. In response to signals from central switch 37, a predetermined operation is carried out. For example, the music number that has been selected in the operation by operating section 32A is played.

When the driver pushes operating section 32A on the front side or the back side of operating body 32, operating body 32 tilts in the pushed direction, and peripheral switch 38 disposed under the pushed position is turned on. Through such operation, for example, the volume level is controlled.

In the night or in a dark place, such as in a tunnel, when the driver operates a lighting switch (not shown) other than multidirectional operation switch 20, a corresponding electronic circuit allows LEDs 39 to emit light. The light of each LED 39 goes through light guiding cylinder 35A of holding base 35 and illuminates translucent display section 32B of operating section 32A disposed above. Such illuminated operating section 32A provides the driver with easy recognition for operation.

As described earlier, the rotational center of the rocking (pivot) movement of operating body 32 coincides substantially with the position at which the upper end of push element 40A is in contact with push section 34A. Therefore, even if operating body 32 is operated to tilt, the tip position of push section 34A disposed above central switch 37 stays in place without movement in the vertical direction and in the horizontal crisscross directions. This structure prevents central switch 37 from unintended operation even if components have variations in dimension or have expansion or contraction in an operating environment.

Figure 7B:
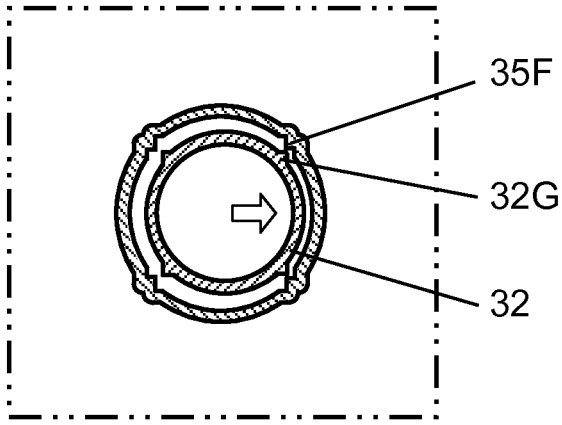
Figure 7C:
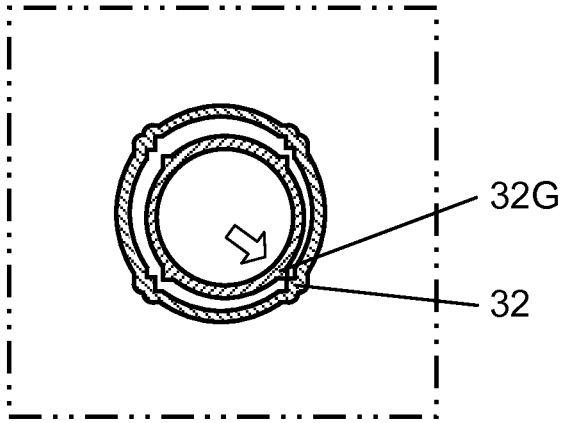

Controllers 32G of operating body 32 and receptors 35F of holding base 35 configures a control mechanism capable of restricting the direction of the rocking movement of operating body 32. By virtue of the structure, when the driver pushes operating section 32A of operating body 32, peripheral switch 38 corresponding to the pushed position turns on with reliability. The reason will be described with reference to FIGS. 7A through 7C. FIGS. 7A through 7C are sectional views showing an essential part of the multidirectional operating switch shown in FIG. 1.

FIG. 7A shows the positional relation between receptors 35F and controllers 32G in the state where no pushing force is applied to multidirectional operating switch 30 of FIG. 1. Receptors 35F are disposed on cylindrical wall 35G of holding base 35 at equal intervals of 90 degrees. Under the state of no pushing force on the switch, controller 32G faces receptor 35F in a manner that the outward vertex of controller 32G and the inward vertex of receptor 35F have a predetermined interval therebetween.

When the driver pushes push section 32A on the right side, operating body 32 has a right-down tilt. At that moment, as shown in FIG. 7B, two controllers 32G at the upper-right and the lower-right move toward the right, while the outer rim of each of controllers 32G at the upper-right and the lower-right is guided by the inner rim of each of corresponding receptors 35F at the upper-right and the lower-right. As a result, operating body 32 has a right-down tilt without dislocation in the front-back direction, thus pushes peripheral switch 38 on the right side to establish electrical connection reliably.

If the driver accidentally pushes the mid position of operating sections 32A at the right and at the front, as shown in FIG. 7C, operating body 32 tilts toward the pushed direction. At that time, the tip of controller 32G at the lower-right makes contact with corresponding receptor 35F, which hampers further movement in an "oblique" direction. As a result, operating body 32 tilts toward the right shown in FIG. 7B or toward the front.

As described above, if the driver pushes the mid position of operating sections 32A, the control mechanism described above hampers the tilt in the oblique direction of operating body 32, preventing simultaneous turn-on of two peripheral switches 38. As a result, electrical connection of peripheral switch 38 in an intended operating direction is established with reliability.

According to multidirectional operating switch 30, support 32D having a spherically convex surface is disposed at the lower end of central cylinder 32C of operating body 32. On the upper surface of holding base 35, retainer 35B having a spherically concave surface is disposed opposite to support 32D. The movement of support 32D sliding over retainer 35B allows operating body 32 to tilt in predetermined multiple directions. Besides, the rotational center of the tilt (rocking) movement of operating body 32 coincides substantially with the position at which push element 40A is in contact with push section 34A disposed at the lower end of push piece 34 attached to push button 33. Receiving the driver's pushing force on operating section 32A of operating body 32, support 32D and retainer 35B have a sliding engagement on their spherical surfaces. This allows operating body 32 to have a smooth tilt movement on the position at which push button 33 makes contact with push element 40A, so that peripheral switch 38 disposed under pushed operating section 32A turns on with reliability. In addition, the contact position of push button 33 and push element 40A has no vertical movement, preventing central switch 37 from unintended turn-on. With the structure above, multidirectional operating switch 30 offers reliable switching operation.

On the lower end of central cylinder 32C of operating body 32, controllers 32G are disposed at established intervals. Having a triangular shape, each of controllers 32G protrudes downward. On the upper surface of holding base 35, triangular receptors 35F are disposed opposite to controllers 32G. Engagement of controllers 32G and receptors 35F allows operating body 32 to have restraint on tilt directions. If operating body 32 is pushed in an oblique direction other than intended directions, the tilt in the oblique direction is hampered by the components above. As a result, operating body 32 tilts in an intended direction, allowing peripheral switch 38 corresponding to the tilt to be turned on with reliability. The multidirectional operating switch thus offers reliable switching operations without switching error.

Meanwhile, it is preferable that the triangular shapes of controller 32G and receptor 35F are isosceles triangles so that operating body 32 can tilt in the same condition on both sides with respect to the vertex angles of controller 32G and receptor 35F. In addition, the vertex angles of controller 32G and receptor 35F are preferably 90° or around 90° in a case that operating body 32 is operable in four directions as described in the present embodiment. The vertex angles of controller 32G and receptor 35F can be changed in response to the number of operable directions of operating body 32.

Figure 9:
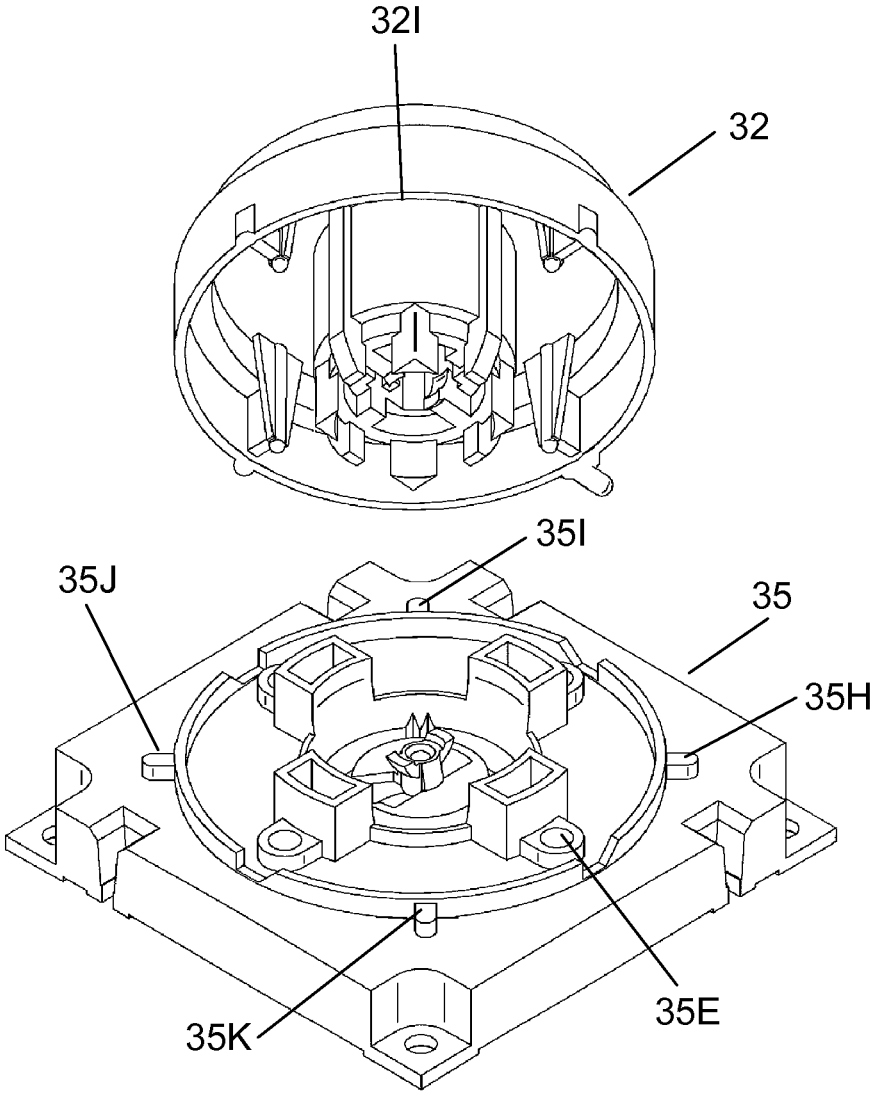
FIG. 9 is a perspective view showing the essential part of another multidirectional operating switch in accordance with the exemplary embodiment of the present invention.
Figure 10A:
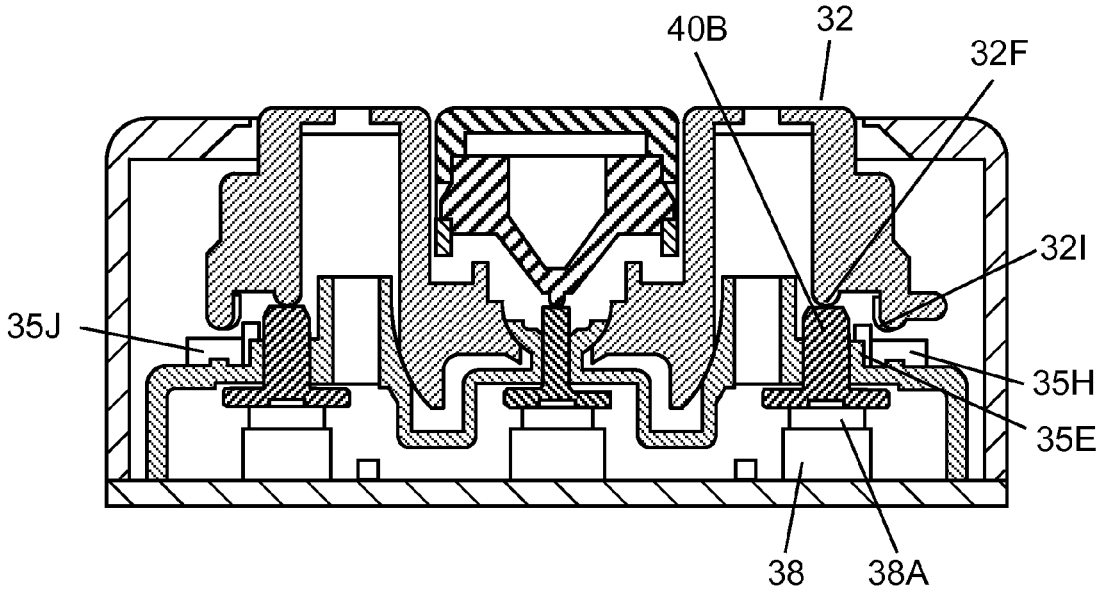
FIGS. 10A and 10B are sectional views of the multidirectional operating switch of FIG. 9 in operation.
Figure 10B:
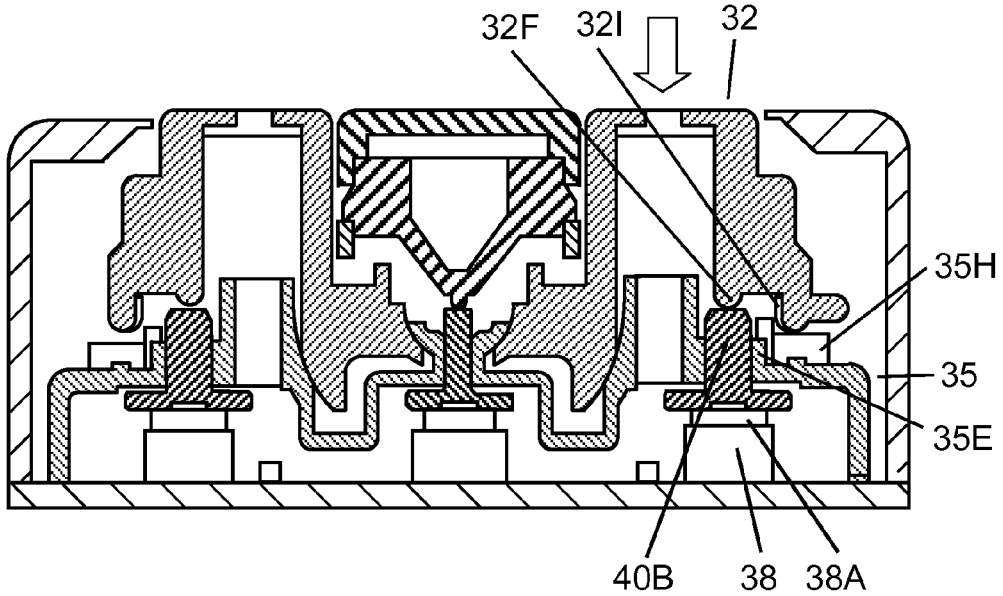
Figure 11:
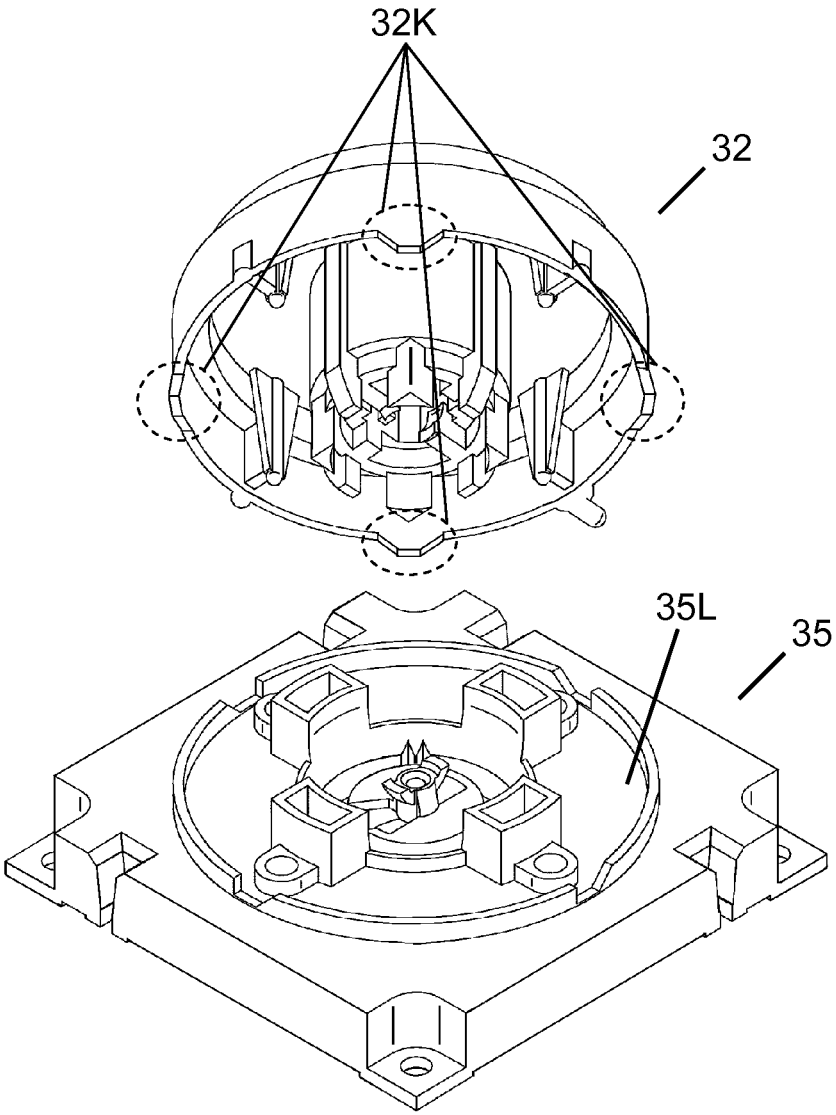
FIG. 11 is a perspective view showing the essential part of still another multidirectional operating switch in accordance with the exemplary embodiment of the present invention.
Figure 12:
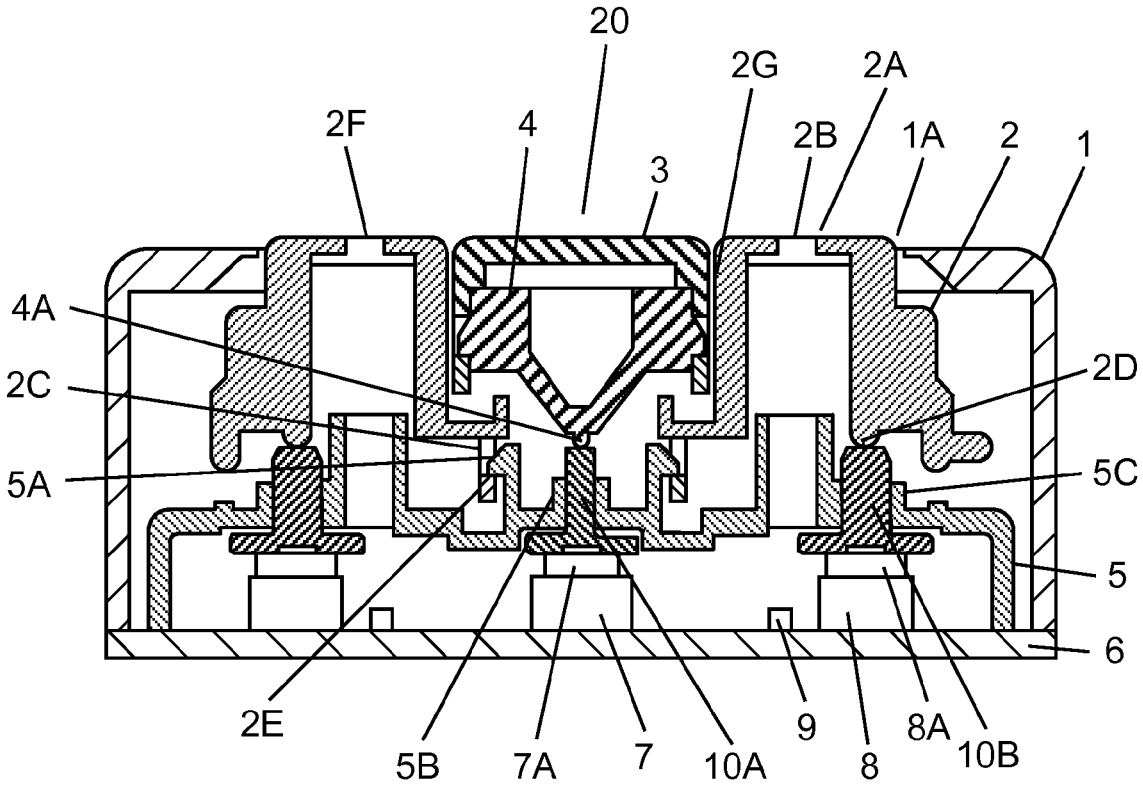
FIG. 12 PRIOR ART
FIG. 12 is a sectional view showing a conventional multidirectional operating switch.
Figure 13:
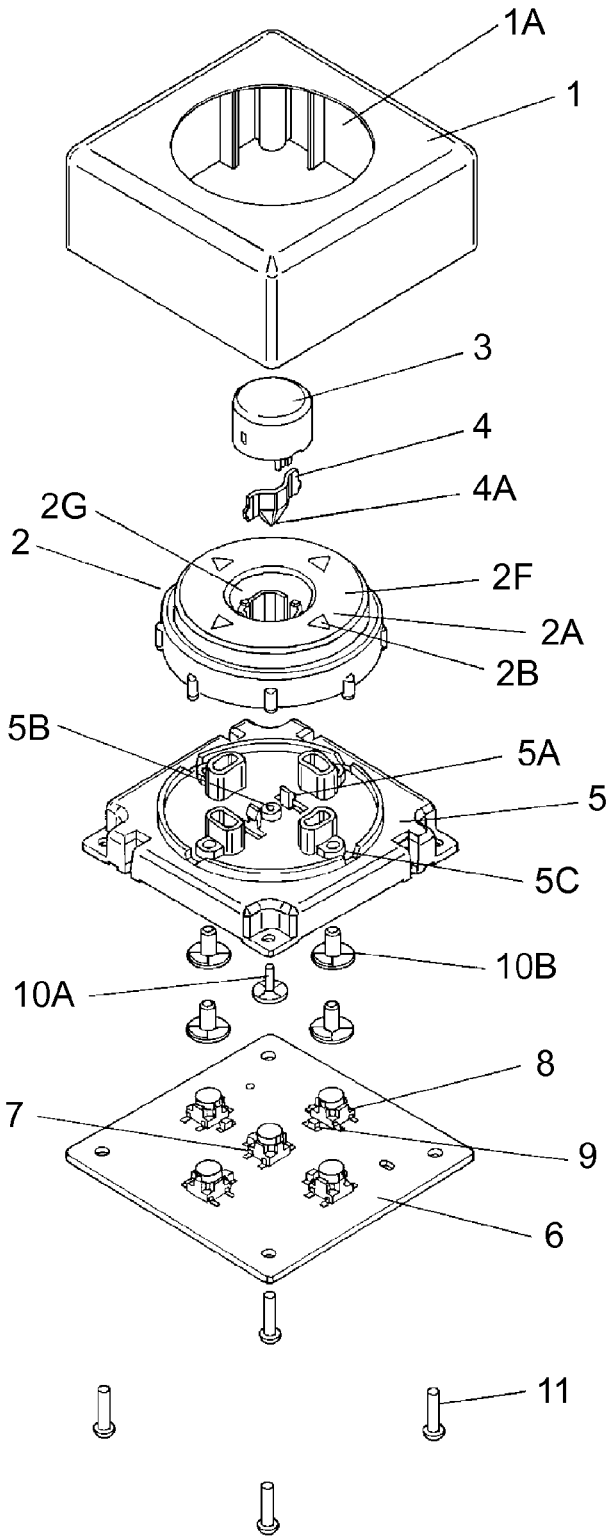
FIG. 13 PRIOR ART
FIG. 13 is an exploded perspective view showing the multidirectional operating switch shown in FIG. 12.
Figure 14A:
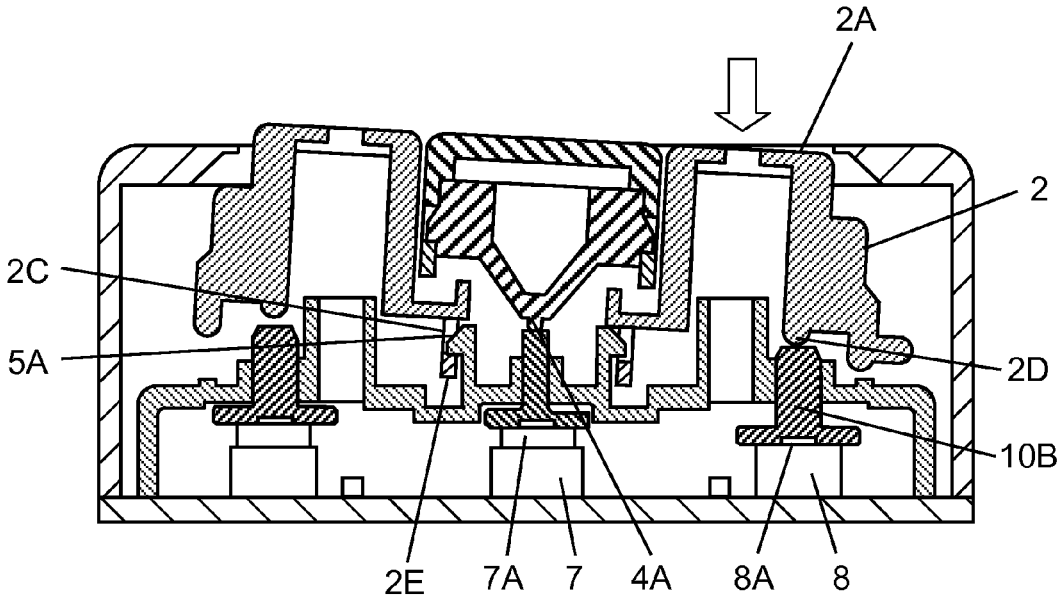
FIG. 14A PRIOR ART
FIGS. 14A and 14B are sectional views of the multidirectional operating switch of FIG. 12 in operation.
Figure 14B:
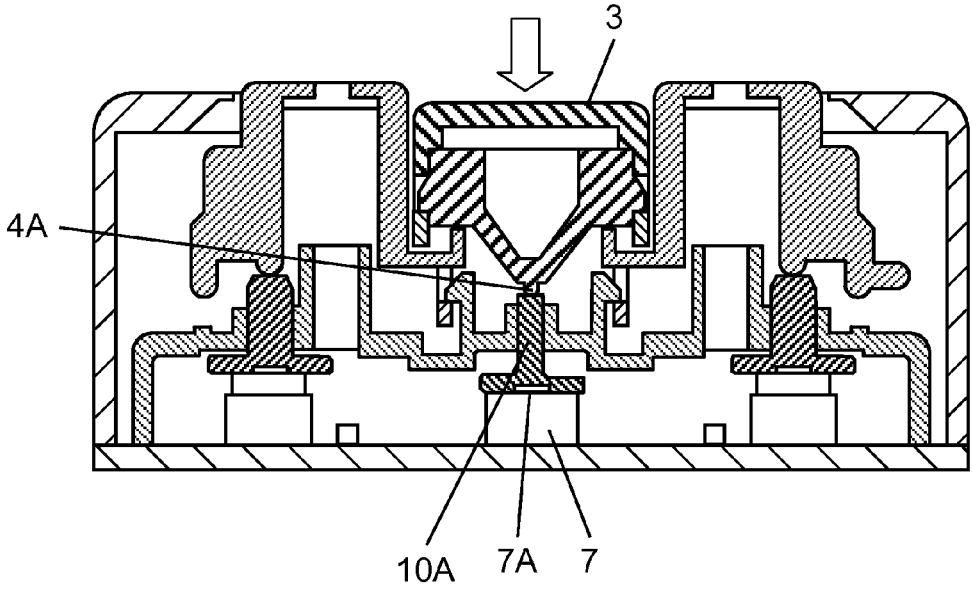
FIG. 14B PRIOR ART

Next, a further preferred structure of the multidirectional operating switch of the embodiment will be described with reference to FIGS. 9 through 11. FIG. 9 is a perspective view showing the essential part of another multidirectional operating switch in accordance with the exemplary embodiment of the present invention. FIGS. 10A and 10B are sectional views of the multidirectional operating switch of FIG. 9 in operation. FIG. 11 is a perspective view showing the essential part of still another multidirectional operating switch in accordance with the exemplary embodiment of the present invention.

According to the structure in FIG. 9, on the upper surface of holding base 35, stoppers 35H, 35I, 35J, and 35K are disposed at positions where they face the lower end of the outer periphery of operating body 32. Each of stoppers 35H, 35I, 35J, and 35K is located at the midpoint of adjacent peripheral guiding cylinders 35E. Located at 90° intervals, stoppers 35H, 35I, 35J, and 35K project with a predetermined height. In other words, holding base 35 has stoppers 35H, 35I, 35J, and 35K having a predetermined height on the upper surface, each of which is located at an angular position midway between adjacent two of peripheral push elements 40B.

If the driver accidentally pushes operating body 32 in an oblique direction between two adjacent intended rockable directions, the lower end of the outer periphery of operating body 32 abuts against one of stoppers 35H through 35K according to the direction in which operating body 32 tilts. The lower end of the outer periphery of operating body 32 constitutes abutment section 32I. The structure prevents switching error in which adjacent two peripheral switches 38 can be turned on at the same time in response to the tilt of operating body 32 accidentally pushed by the driver in an oblique direction.

For example, suppose that the driver pushes operating body 32 in an oblique direction from the non-operation state shown in FIGS. 9 and 10A. The oblique direction corresponds to the direction of stopper 35H located at the midpoint of adjacent two peripheral guiding cylinders 35E in which push elements 40B on the right-side and on the front-side are inserted, respectively. Receiving the driver's pushing force, as shown in FIG. 10B, abutment section 32I of operating body 32 abuts against stopper 35H of holding base 35. This hampers further downward movement of operating body 32. At that time, each of two push sections 32F disposed on both sides of stopper 35H pushes down push button 38A of corresponding peripheral switch 38 via push element 40B; however, the downward movement of push element 40B is too small to turn on peripheral switch 38. This prevents switching error in which adjacent two peripheral switches 38 are turned on at the same time.

Meanwhile, when operating body 32 tilts to the right for example, corresponding peripheral switch 38 turns on via push section 32F and push element 40B on the right side as described above. After that, the lower end of the outer periphery of operating body 32 (i.e., abutment section 32I) abuts against stoppers 35H and 35I, which stops the tilt movement of operating body 32.

In other words, when the driver tilts operating body 32 in any one of the intended four directions, peripheral switch 38 located in the pushed direction turns on with reliability. After that, the lower end of the outer periphery of operating body 32 abuts against adjacent two stoppers, out of stoppers 35H through 35K, located on the both sides of tilt direction, which stops the tilt movement of operating body 32. When the driver tilts operating body 32 in an oblique direction, abutment section 32I of operating body 32 abuts against one of stoppers 35H through 35K corresponding to the oblique direction, preventing simultaneous turn-on of peripheral switches 38 located on the both sides of the stopper. Stoppers 35H through 35K have a height such that the aforementioned switching control is attained.

As described above, the structure formed of operating body 32 having controllers 32G and holding base 35 having receptors 35F imposes a restraint on tilt movement of operating body 32 in an oblique direction. Further, the structure formed of operating body 32 having abutment section 32I and holding base 35 having stoppers 35H through 35K with a predetermined height imposes a reliable restraint on the tilt movement in an oblique direction. Especially, the latter structure enhances the reliability of tilt movement in the predetermined directions. Therefore, even if the driver tilts operating body 32 in an oblique direction, the structure imposes a restraint on downward movement of operating body 32, and yet operating body 32 can easily tilt (rock) to the predetermined direction reliably. This hampers simultaneous turn-on of two peripheral switches 38 adjacent to the tilt direction, preventing the switch from switching error.

Alternatively, stoppers 32K protruding from the outer periphery so as to have a predetermined height can be formed on the lower end of the outer periphery of operating body 32 as shown in FIG. 11. In the structure, upper parts of holding base 35 that meet with stoppers 32K serve as abutment section 35L. Each stopper 32K is disposed on the lower end of the outer periphery of operating body 32 at an angular position midway between adjacent two push elements 40B. Each stopper 32K has a predetermined height. On the upper surface of holding base 35, abutment section 35L is disposed so as to meet with each stopper 32K. As another possibility, stoppers 35H through 35K shown in FIG. 9 may be combined with stoppers 32K shown in FIG. 11. In the combined structure, both of operating body 32 and holding base 35 have protruded sections; that is, operating body 32 has first stoppers and holding base 35 has second stoppers. Both of the structure of FIG. 11 and the combined structure of FIG. 9 and FIG. 11 are as effective as that of FIG. 9. Note here that the abutment section and the stoppers can be formed without controllers 32G and receptors 35F.

In the description above, push piece 34 is fixed in push button 33, and push section 34A at the lower end of push piece 34 is in contact with push element 40A, but it is not limited thereto. Alternatively, push button 33 may be extended downward so as to form a push section at the extended lower end, for example. In that case, the push section formed on the lower end of the push button is directly in contact with push element 40A.

In the structure as described above, push button 37A of central switch 37 is pushed by push section 34A via push element 40A, and push buttons 38A of peripheral switches 38 are pushed by push sections 32F via push elements 40B. However, it is not limited thereto. For example, the push button may be extended upward, i.e., the push element and the push button may be formed into a one-piece structure. In that case, each push button of the central switch and the peripheral switches is directly pushed by the operation button or the push sections formed on the lower end of the operating section, so that each switch is turned on.

Although operating body 32 is rockable in the four directions of front, back, right, and left in the structure, it is not limited thereto. Adding necessary components to the structure—additional supports and controllers in the operating body and additional retainers and receptors in the holding base—allows operating body 32 to be rockable in more-than-four directions, for example, six or eight directions.

Although the structure of the embodiment employs push switches as single parts for central switch 37 and peripheral switches 38, the switch may be made of different materials and formed into different structures. For example, a carbon-made fixed contact may be formed on the upper surface of wiring board 36, and over the fixed contact, a dome-shaped movable contact made of a conductive sheet metal may be mounted. Alternatively, a dome-shaped flexible rubber contact under which a movable contact is formed may be used. The structure of central switch 37 and peripheral switches 38 is not limited to the structure described in the embodiment.

As described above, the multidirectional operating switch with a simple structure offers reliable and user-friendly switching operations. The multidirectional operating switch is thus useful for operating electronic equipment mounted on a car.

What is claimed is:

1. A multidirectional operating switch comprising:

a case having an opening at a top portion thereof;

an operating body accommodated in the case, the operating body including an operation face exposed upwardly out of the opening of the case, a cylinder portion extending downwardly from a bottom side of the operation face, and a support having a curved convex surface disposed at a lower end of the cylinder portion, said curved convex surface facing downwardly and outwardly;

a holding base accommodated in the case, the holding base including a retainer having a curved concave surface facing upwardly and inwardly and being disposed opposite to the curved convex surface of the support of the operating body so that the curved concave surface faces the curved convex surface so as to retain the operating body such that the operating body is rockable in predetermined directions;

an operation button movably disposed in the cylinder portion of the operating body;

a central push element supported by the holding base and arranged to be pushed by the operation button upon predetermined movement of the operation button;

a central switch capable of establishing electrical connection via the central push element when the central push element is pushed by the predetermined movement of the operation button;

peripheral push elements supported by the holding base radially outwardly of the central push element and arranged to be pushed upon predetermined rocking of the operating body in the predetermined directions; and peripheral switches capable of establishing electrical connection via the peripheral push elements, respectively, when the push elements are pushed by the predetermined rocking of the operating body in the predetermined directions, respectively.

2. The multidirectional operating switch according to claim 1, wherein the operating body contains controllers each having a triangular bottom and disposed at a position along a direction midway between adjacent two of the rockable directions of the operating body so as to protrude downwardly at established intervals from the lower end of the cylinder portion, the holding base contains receptors each having a triangular top and disposed at a position corresponding to each of the controllers of the operating body, and each of the controllers is disposed in a manner such that a vertex of the triangular bottom is directed outwardly, whereas each of the receptors is disposed in a manner such that a vertex of the triangular top is directed inwardly, and engagement of the controllers and the receptors allows the operating body to have a restraint on the rocking of the operating body in the predetermined directions.

3. The multidirectional operating switch according to claim 1, wherein the operating body has an abutment section on a lower end of a periphery thereof, the holding base has a stopper having a predetermined height on an upper surface at a midway angular position midway between adjacent two of the peripheral push elements, and the stopper and the abutment section are arranged such that, in response to rocking movement of the operating body in a direction toward the midway angular position, engagement of the stopper and the abutment section hampers downward movement of the operating body.

4. The multidirectional operating switch according to claim 1, wherein the operating body has a stopper with a predetermined height on a lower end of a periphery thereof at a midway angular position midway between adjacent two of the peripheral push elements, the holding base has an abutment section on an upper surface at a position where the abutment section meets with the stopper, and the stopper and the abutment section are arranged such that, in response to rocking movement of the operating body in a direction toward the midway angular position, engagement of the stopper and the abutment section hampers downward movement of the operating body.

5. The multidirectional operating switch according to claim 1, wherein the operating body has a first stopper with a predetermined height on a lower end of a periphery thereof at a midway angular position midway between adjacent two of the peripheral push elements, the holding base has a second stopper with a predetermined height on an upper surface at a position where the second stopper meets with the first stopper, and the first and second stoppers are arranged such that, in response to rocking movement of the operating body in a direction toward the midway angular position, engagement of the first stopper and the second stopper hampers downward movement of the operating body.

6. The multidirectional operating switch according to claim 1, wherein the curved convex surface of the support is a spherical curved convex surface, and the curved concave surface of the retainer is a spherical curved concave surface.

7. The multidirectional operating switch according to claim 1, wherein the peripheral push elements are supported by the holding base in such a manner that movement of each of the peripheral push elements upon being pushed is guided by the holding base.

8. The multidirectional operating switch according to claim 1, wherein the operation button is exposed upwardly out of the opening of the case.

9. The multidirectional operating switch according to claim 1, wherein said cylinder portion of the operating body constitutes an inner cylinder portion, and the operating body further includes an outer portion disposed outwardly of the inner cylinder portion, the outer portion has, at a lower end portion thereof, push sections arranged for direct contact with the peripheral push elements, respectively, to push the peripheral push elements upon rocking of the operating body in the predetermined directions, respectively.

10. The multidirectional operating switch according to claim 9, wherein the outer portion of the operating body is an outer cylinder portion.

11. The multidirectional operating switch according to claim 9, wherein the push sections are contacted directly against the peripheral push elements, respectively.

12. The multidirectional operating switch according to claim 1, wherein the operation button is movably supported by the cylinder portion of the operating body so as to be linearly movable in the cylinder portion.

13. The multidirectional operating switch according to claim 1, wherein said case is a box-shaped case.

14. The multidirectional operating switch according to claim 1, wherein the operation button has a push piece that contacts with the central push element at a contact position, the operating body is rockable about a rotation center, and the rotation center is coincident with the contact position at which the push piece contacts the central push element.

15. The multidirectional operating switch according to claim 1, wherein the operating body is configured and arranged so that, when the operation face is pushed downward at one location radially outward of the cylinder portion, the curved convex surface of the support is caused to press downwardly against and slide relative to the curved concave surface of the retainer to result in the predetermined rocking of the operating body in one of the predetermined directions.

16. A multidirectional operating switch comprising:

a case having an opening;

an operating body accommodated in the case, the operating body including an operation face exposed out of the opening of the case, an inner cylinder portion extending from a bottom side of the operation face, a support having a curved convex surface disposed at a lower end of the inner cylinder portion, and an outer portion disposed outwardly of the inner cylinder portion;

a holding base accommodated in the case, the holding base including a retainer having a curved concave surface disposed opposite to the curved convex surface of the support of the operating body so as to retain the operating body such that the operating body is rockable in predetermined directions;

an operation button movably disposed in the inner cylinder portion of the operating body, a central push element supported by the holding base and arranged to be pushed by the operation button upon predetermined movement of the operation button;

a central switch capable of establishing electrical connection via the central push element when the central push element is pushed by the predetermined movement of the operation button;

peripheral push elements supported by the holding base radially outwardly of the central push element and arranged to be pushed upon predetermined rocking of the operating body in the predetermined directions;

peripheral switches capable of establishing electrical connection via the peripheral push elements, respectively, when the push elements are pushed by the predetermined rocking of the operating body in the predetermined directions, respectively;

wherein the outer portion of the operating body has, at a lower end portion thereof, push sections arranged for direct contact with the push elements, respectively, to push the push elements upon rocking of the operating body in the predetermined directions, respectively; and wherein the push sections of the outer portion of the operating body and the peripheral push elements are located radially outwardly of the curved convex surface of the support of the operating body and the curved concave surface of the retainer of the holding base.

17. The multidirectional operating switch according to claim 16, wherein the outer portion of the operating body is an outer cylinder portion.

18. The multidirectional operating switch according to claim 17, wherein the outer cylinder portion extends from a bottom side of the operation face of the operating body.

19. The multidirectional operating switch according to claim 16, wherein the push sections are contacted directly against the push elements, respectively.

20. A multidirectional operating switch comprising:

a box-shaped case with an opening;

an operating body accommodated in the case, the operating body including an operation face exposed out of the opening of the case, a cylinder extending from a rear side of the operation face, and a support having a spherically convex surface disposed at a lower end of the cylinder;

a holding base accommodated in the case, the holding base including a retainer having a spherically concave surface disposed opposite to the support of the operating body so as to retain the operating body being rockable in predetermined directions;

peripheral push elements located in the rockable directions of the operating body, and guided by the holding base;

peripheral switches each capable of establishing electrical connection via one of the peripheral push elements in response to rocking movement of the operating body;

an operation button disposed in the cylinder of the operating body so as to be movable linearly, and exposed at the opening of the case;

a central push element located in a movable direction of the operation button, and guided by the holding base; and a central switch capable of establishing electrical connection via the central push element in response to movement of the operation button, wherein a rotational center of the operating body coincides with a contact position of the operation button and the central push element;

wherein the operating body contains controllers each having an engagement portion and disposed at a position along a direction midway between adjacent two of the rockable directions of the operating body, such that the controllers protrude downwardly at established intervals from a lower end of the cylinder, the holding base contains receptors each having an engagement part and disposed at a position corresponding to each of the controllers of the operating body, and the controllers and the receptors are arranged such that the engagement portions of the controllers are engageable with the engagement parts of the receptors, and engagement of the engagement portions of the controllers and the engagement parts of the receptors causes a restraint on the rockable directions of the operating body.

21. The multidirectional operating switch according to claim 20, wherein the cylinder of the operating body is a central cylinder;

the engagement portions of the controllers are constituted by triangular bottoms thereof that have outwardly directed vertexes; and the engagement parts of the receptors are constituted by triangular tops thereof that have inwardly directed vertexes.

* * * * *